United States Patent [19]

Sauvestre

[11] Patent Number: 4,788,915

[45] Date of Patent: Dec. 6, 1988

[54] HUNTING AMMUNITION COMPRISING A BULLET OF INCREASED EFFECTIVENESS

[76] Inventor: Jean-Claude Sauvestre, 11, rue de Veauce, 18230 Saint Doulchard, France

[21] Appl. No.: 55,907

[22] Filed: May 29, 1987

[30] Foreign Application Priority Data

Jun. 5, 1986 [FR] France ..... 8608093

[51] Int. Cl.[4] ..... F42B 11/00

[52] U.S. Cl. ..... 102/439; 102/501; 102/517; 102/521; 102/703; 102/529; 102/506; 102/507

[58] Field of Search ..... 102/372, 501, 491–497, 102/506–510, 517, 529, 439, 703, 444

[56] References Cited

U.S. PATENT DOCUMENTS

| | | | |
|---|---|---|---|
| 2,113,313 | 4/1938 | Brandt | 102/372 |
| 3,545,383 | 12/1970 | Lucy | 102/517 |
| 3,866,536 | 2/1975 | Greenberg | 102/91 |
| 3,880,083 | 4/1975 | Wasserman et al. | 102/92.4 |
| 3,881,421 | 5/1975 | Burczynski | 102/92.2 |
| 3,941,059 | 3/1976 | Cobb | 102/91 |
| 3,977,324 | 8/1976 | Stevenson et al. | 102/38 |
| 4,123,975 | 11/1978 | Mohaupt | 102/92.4 |
| 4,140,061 | 2/1979 | Campoli | 102/529 |
| 4,428,294 | 1/1984 | Falkowski | 102/439 |
| 4,535,698 | 8/1985 | Yuen | 102/529 |
| 4,550,662 | 11/1985 | Burczynski | 102/509 |
| 4,655,140 | | | |

FOREIGN PATENT DOCUMENTS

| | | |
|---|---|---|
| 2513368 | 3/1982 | France . |
| 953557 | 3/1964 | United Kingdom . |

OTHER PUBLICATIONS

Ordnance, vol. 57, Jan.–Feb. 1973, pp. 313–315.

*Primary Examiner*—Harold J. Tudor
*Attorney, Agent, or Firm*—Steinberg & Raskin

[57] ABSTRACT

The invention relates in particular to hunting ammunition for a fire-arm of the kind having a subcaliber bullet fitted with a feathering, the subcaliber bullet allowing for destabilization on its trajectory beyond a distance travelled outside of the fire-arm.

10 Claims, 3 Drawing Sheets

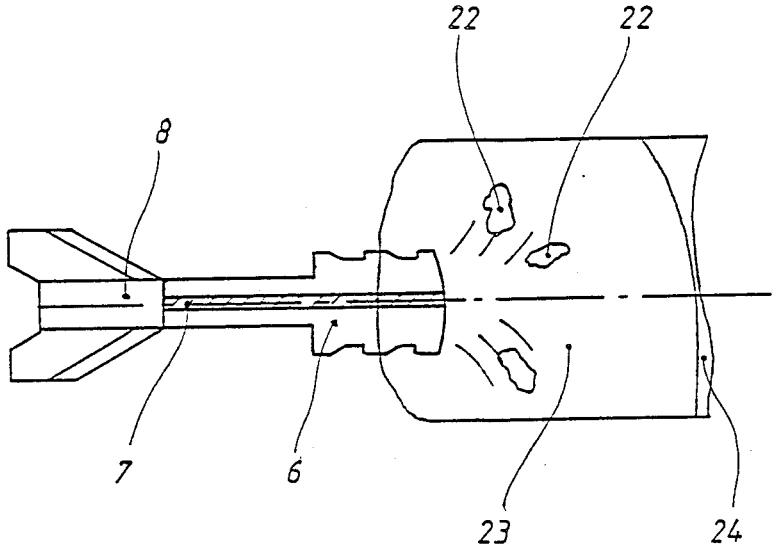
Fig 3
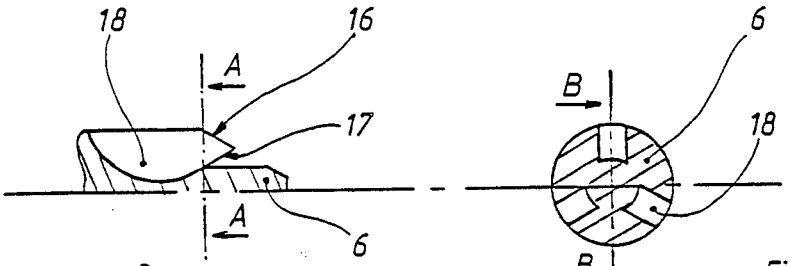
Fig 4a
Fig 4b
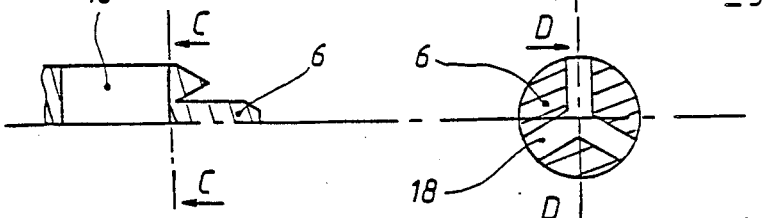
Fig 4c
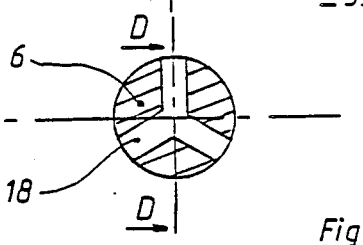
Fig 4d 6
6
16
17

16
17
27

HUNTING AMMUNITION COMPRISING A BULLET OF INCREASED EFFECTIVENESS

BACKGROUND OF THE INVENTION

The present invention relates to ammunitions for a fire-arm or weapon of small or medium calibre and in particular ammunitions for hunting fire-arms or weapons.

The French Pat. No. 83.18988 discloses an ammunition for a hunting fire-arm comprising an subcaliber projectile or missile stabilized by a feathering or tail fins, the projectile consisting of a bullet and of a sabot.

The bullet disclosed in that patent is tapered and made from a dense alloy thereby allowing to increase the surface energy on impact and to decrease the mass of the ammunition.

Such a bullet exhibits two kinds of inconveniences; if the risk of ricochet under a great incidence is low, the high surface energy would risk to cause but slight wounds to the game, the bullet running through a portion of the soft fleshes without substantial damages and risking owing to the incidence to be unable to reach the hard portions of the animal such as the bones.

Another inconvenience of the bullet according to the prior state of known art is that its stability on its path of travel would incur the risk, if the target is missed, to carry it far away from the shooter with a substantial kinetic energy which may be detrimental to the safety of the other shooters or other persons located nearby.

SUMMARY OF THE INVENTION

It is an object of the present invention to increase the terminal effectiveness of a subcaliber bullet by associating the wounding capacity for the fleshes of the animal with the kinetic efficiency on the hard portions.

It is another object of the present invention to propose a bullet of great stability on its path of travel but which would destabilize or become unstable systematically beyond a certain distance.

The invention therefore relates to an ammunition for a small-or medium-calibre fire-arm or weapon and in particular for a hunting fire-arm, of the type comprising a projectile consisting of a subcaliber bullet fitted with a feathering or fins at its rear portion and driven at a supersonic speed at the fire-arm outlet or nozzle and a sabot gauged to the fire-arm calibre, characterized in that the bullet comprises means allowing to destabilize it on its trajectory beyond a distance travelled outside of the fire-arm.

The destabilizing means consist in a particular architecture or construction of the bullet placing the centre of gravity of the latter on the centreline axis of the bullet and at a distance d of the aerodynamic center of the pressure the bullet at the fire-arm outlet or nozzle, d lying between one half of and twice the maximum diameter of the bullet without the feathering.

According to another characterizing feature, the bullet consists of at least three elements: a bar, a head and a feathering, the head being the element located at the forward portion of the bullet. The bar may be fully included into the assembly consisting of the head and the feathering; it may be solid or integral with the head or the feathering and the feathering may itself be solid or integral with the head.

According to a particular embodiment, the bullet comprises at its forward portion at least one conical surface the centreline axis of which is that of the bullet and associated with at least one incipient breaking point in order to provide, upon the impact, for a fragmenting of the bullet head.

Preferably, the bullet comprises two concurrent or converging conical surfaces the centreline axis of which is that of the bullet. One of both conical surface has its portion of larger diameter facing forward or ahead of the bullet whereas the other conical surface has its portion of larger diameter facing backwards of the bullet.

According a particular embodiment, at least one incipient breaking point consists of a slit parallel to this centreline axis of the bullet.

According to another particular embodiment, at least one incipient breaking point consists of a cylindrical groove opening forwards or ahead of the bullet and extending rearwards of the latter and having its centreline axis parallel or confounded with the centreline axis of the bullet.

According to another particular embodiment, the incipient breaking points consist of three slots extending radially from the outside towards the centreline axis of the bullet and spaced by 120°.

At last, the feathering should preferably be made from plastics material containing or devoid of a filler and the head made of lead.

BRIEF DESCRIPTION OF THE DRAWINGS

For a fuller understanding of the invention, reference is made to the following description taken in conjunction with the accompanying drawings, in which:

FIG. 3 illustrates the mode of action of the bullet on a game;

FIGS. 4*a, b, c, d* partially show two embodiments of the head of the bullet according to the invention; FIGS. 4*b* and 4*d* being sections taken upon the planes AA and CC of FIGS. 4*a* and 4*c*, respectively whereas FIGS. 4*a* and 4*c* are sections taken upon the planes BB and DD of FIGS. 4*b* and 4*d*, respectively.

DETAILED DESCRIPTION OF THE PREFERRED EMBODIMENTS

Figure 1:
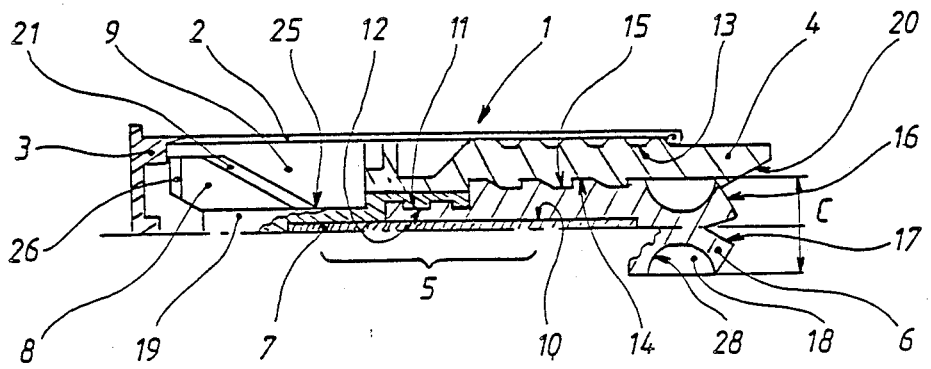
FIG. 1 shows a view in half section of an ammunition according to the invention.

FIG. 1 shows in half section an ammunition 1 consisting of a case 2 made of plastics material, cardboard or burnable material secured in a known manner (through adhesive bonding, sticking or gluing for instance) onto a base 3 which carries a primer not shown here.

Inside of the case 2 is a projectile consisting of a subcaliber bullet 5 and a sabot 4. The bullet 5 comprises a head 6 forward of the ammunition; this head has a substantially cylindrical shape of diameter C and comprises at its forward end a conical surface 16 the portion of larger diameter of which is facing backwards of the bullet and another conical surface 17 the portion of larger diameter of which is facing forwards of the bullet. Three slots 18 starting from the outside of the head 6 and extending towards the centreline axis of the bullet and regularly spaced from each other by 120° are located slightly rearwards of the conical surface 16. These slots do not open endwise and their bottoms 28 have substantially cylindrical profiles.

The use of these conical surfaces and of these slots will be specified hereinafter.

At the rear portion of the head 6 is a portion of a diameter smaller than C and carrying angular grooves 12; these grooves co-operate with a similar profile 11 carried by a part 19 solid with a feathering 8 so as to connect said feathering to the head 6. Preferably, the part 19 and the feathering 8 constitute one and same single piece or unit. The fins or vans forming the feathering carry each one on their leading edge (facing forwards of the bullet) a chamfer or bevel 21; they also carry each one a chamfer or bevel 26 on their trailing edge (facing backwards of the bullet). A bar 7 is fully inserted or embedded into the assembly consisting of the feathered part 19 and of the head 6; this bar comprises a screw threading 10 which allows to rigidly connect it to the head and to the feathered part.

At least, the head 6 comprises on its outside surface a number of indents or jags 14 which co-operate with grooves 16 formed on the inner surface of a sabot 4 so as to make the bullet 5 fully solid with said sabot.

The sabot has an outer diameter equal to the inner diameter of the case 2. A clamping of said case through winding about the sabot makes it rigidly connected with the projectile (the rear portion of the feathering 8 bearing upon the base 3).

The outer surface of the sabot comprises a number of grooves 13 intended to prevent the gases evolving from the burning of a propellant charge not shown here and contained in a chamber 9 from moving or flowing forwards of the ammunition.

The sabot 4 consists in a known way of two halves intended to separate or part from each other at the fire-arm outlet or nozzle under the effect of the air pressure acting forward of the sabot upon a conical surface 20 and this, to release the bullet 5.

The operation of the device is the following:

The ammunition is placed into the chamber of a fire-arm; the propellant charge contained in the chamber 9 is fired by repercussion of the primer; the pressure of the combustion gases is exerted upon the rear portion of the sabot 4 causing in particular the unsetting and the penetration of the projectile into the tubular gun barrel of the fire arm. At the outlet or nozzle of the tubular gun barrel, the sabot would part into two halve and release the bullet 5.

The bullet 5 driven with an initial velocity would then being its trajectory towards the objective aimed at.

Figure 2:
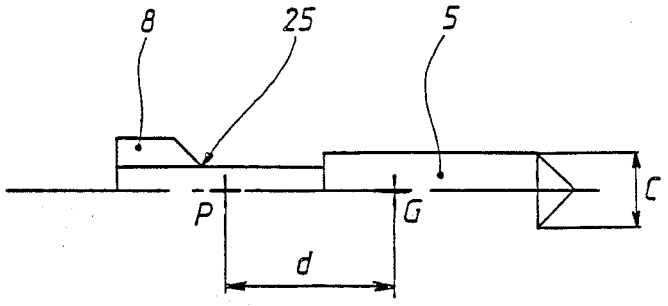
FIG. 2 diagrammatically shows a bullet of the ammunition according to the invention.

The stability of the trajectory depends on a parameter called static margin which is the distance between the centre of gravity and the aerodynamic center of pressure of the bullet. Referring to FIG. 2 showing the bullet 5, the point G gives the position of the centre of gravity and the point P that of the aerodynamic center of pressure. For the supersonic initial velocities of the order of 500 to 700 m/s, the center P lies at the point of meeting of the forward portion of the feathering 8 with the bullet 5 (portion 25) and this too within +2 mm for a feathering span or spread lying between 1×C and 1×1.5C. The projection of this portion 25 on the centreline axis of the bullet should practically be likened to the point P sought; d represents the static margin.

To obtain a good stability hence a great accuracy of the shot, it is necessary to obtain a greatest distance d. The length of the projectile being reduced (about 60 mm), satisfactory values of the static margin (of the order of the calibre C of the projectile and higher) are obtained either by making a very tapered projectile the feathering span of which lies between 2C and 4C (which was proposed by the French Pat. No. 83.18988) or by making the forward portion of the projectile heavier than the rear portion, for instance by associating a leaden head 6 with a feathered portion 19 of plastics (nylon) alloy.

Such a feathering of plastics alloy does not suffer from the very high temperature of the propellant gases nor of the pressure waves generated by said gases or by the outer air during the flight and shots could have been effected at a distance of 250 meters with initial velocities lying between 400 m/s and 700 m/s without any trace of erosion or deformation being apparent on the feathering.

The fins or vanes forming the feathering would advantageously be formed with chamfers or bevels 21 and/or 26 on the leading edge and on the trailing edge and this in order to allow a slight rotation on the trajectory which is another stability factor.

It is therefore seen that the architecture or construction of the bullet according to the invention allows to provide for a good shooting accuracy.

It also allows to provide for the safety of the persons being near the hunter; indeed, the static margin which is characterized by the position of the center P substantially at the point of meeting of the forward portion of the feature 8 with the bullet 5 (portion 25) when the initial velocity is of the order of 500 to 700 m/s (supersonic speed) is rather sharply reduced when the velocity becomes sonic (about 340 m/s). In a practical way, the bullet should be sized so as to have a distance d lying between 0.5×C and 2×C; under such conditions, the change from the supersonic velocity to the sonic velocity would result in a reduction of the static margin such that the bullet is destabilized or becomes unstable and does no longer follow its theoretical trajectory and is brought downwards to the ground.

By way of example, with an initial velocity of 500 m/s applied to a bullet the static margin of which is of the order of its diameter C, the destabilizing occurs when the distance travelled is higher than 150 meters.

With the architecture of the bullet according to the invention is therefore achieved a great accuracy up to about 150 meters associated with a range limitation which is a safety factor.

Another object of the invention is to improve the terminal effectiveness of the bullet.

FIG. 3 diagrammatically shows the manner of action of the bullet. Upon the meeting of the latter with a game and this even under small incidence, the forward portion of the bullet is divided into fragments, splinters 22 penetrating the fleshes 23 of the animal so as to create wounds.

The bullet however has sufficient cohesion owing to the bar 7 for continuing its flight and hitting and breaking the bones 24.

Figures 5A, 5B, 5C, 5D, 5E, 5F, 5G, 5H:
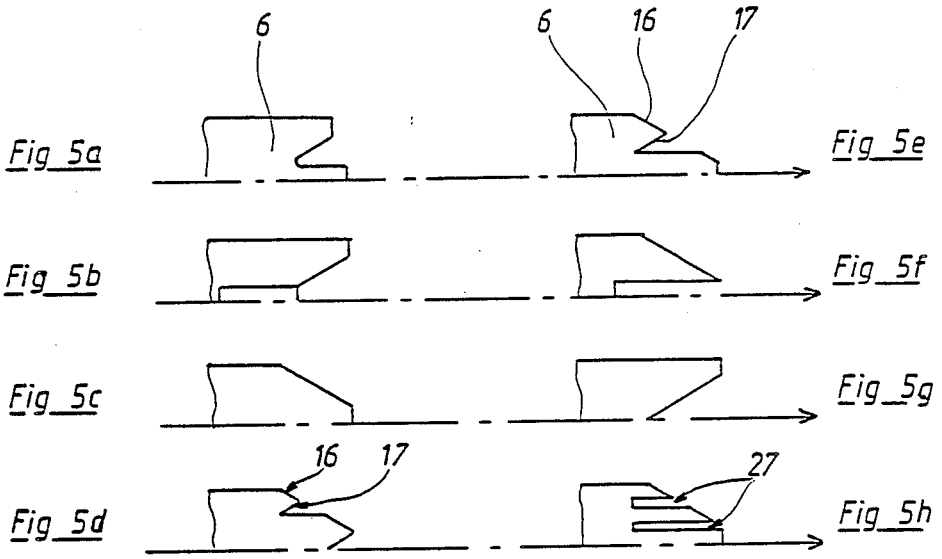
FIGS. 5*a* to 5*h* show as a half view various embodiments of the bullet head.

The fragmentation of the bullet is provided by the conjunction of the conical surfaces and of incipient breaking points. In FIG. 1, two surfaces 16 and 17 associated with three slots 18 allow to fullfil that function. On FIGS. **4*a* and 4*b*, another configuration of the bullet is shown comprising thee slots 18 which are not opening through and two conical surfaces 16 and 17. On FIGS. 4*c* and 4*d*, the slots 18 are opening through. The absence of a quick rotation of the bullet (stabilization through the feathering) allows to adapt a number of frangible bullet structures which it would have been impossible to use with a girostabilized bullet (the speed of rotation being likely to cause breakages). FIGS. 5***a* to 5*h* show some non-limiting examples of frangible bullets according to the invention; attention should be called in particular to FIG. 5*h* where the incipient breaking points consist of two cylindrical grooves 27 parallel to the centreline axis of the bullet.

It has thus been possible to make a head of the type shown on FIGS. 4*a* and 4*b* in which the thickness of the material constituting same and lying between two slots 18 is of about 1 mm for a 12 mm-calibre bullet without the mechanical behaviour of the bullet being affected during the launching phase and during the flight. Such incipient breaking points would provide for a fragmentation of the head into three homogenous splinters of a few grams each one upon the impact.

Likewise, heads of the kind shown on FIGS. 4*c* and 4*d* with three slots 18 opening through could be made, the thickness of the material lying between the slots and the forward end of the bar 7 also being of about one mm as well as a head of the type shown on FIG. 5*h* in which the thickness of the material between each cylindrical groove 27 and between the bottom of each groove and the forward end of the bar 7 is of the order of one mm too.

These various architectures provides for the formation of splinters as from the impact with a target.

Finally, the architecture of the bullet according to the invention allows to facilitate the process of manufacture of the ammunition.

Preferably, a moulding of the leaden head 6 onto the bar 7 should be performed, this moulding allowing to obtain all the structural details in a cheap way; then the feathered portion 19 should be made through thermoplastic injection; the bar 7 serving as a reinforcement as well possibly as one portion of the leaden head. The sabot 4 could then also be obtained through injection onto the bullet previously made.

Other alternative embodiments are possible within the scope of the invention; it is possible for instance to make a head comprising two lead alloys, soft lead for the forward portion and hard lead for the rear portion.

The bar preferably of steel may be made from another material such as brass and exhibit circular indents or jags instead of a screw thread; the length of the bar may be greater or smaller than the length of the head.

The feathering may be a feathering with fins or with a stabilizing cone whether pierced or not.

What is claimed is:

1. Ammunition for small or medium caliber hunting fire-arm, including a case secured to a base carrying a primer;

a projectile contained in the case and constituted by a subcaliber bullet having at least a head forward of the ammunition and a feathering rearwards thereof fixed to said head and a sabot having the caliber of the hunting fire-arm;

a chamber disposed between the sabot and the base and filled with a propellant charge for propelling the projectile when the propellant charge is fired;

said feathering including at least a leading edge facing forwards of the subcaliber bullet which is driven at supersonic speed at the fire-arm outlet and which has a center of gravity located on its centreline axis and an aerodynamic center of pressure located on the centreline axis rearwards of the center of gravity;

said ammunition further comprising means for destabilizing said subcaliber bullet on its trajectory beyond a distance travelled outside of the fire-arm and comprising the aerodynamic center of pressure of the subcaliber bullet being arranged at the point of meeting of the leading edge of the feathering with the centreline axis of the subcaliber bullet and at a distance from the center of gravity of the bullet lying between one half of and twice maximum diameter of the subcaliber bullet without the feathering.

2. Ammunition according to claim 1, wherein the feathering of the subcaliber bullet is fixed to the head thereof through a bar which is fully embedded into an assembly constituted by the head and the feathering.

3. Ammunition according to claim 1, wherein the subcaliber bullet comprises at its forward portion at least one conical surface, a centreline axis of which is that of the subcaliber bullet and associated with at least one incipient breaking point to provide for a fragmentation of the subcaliber bullet head upon the impact of the same against a target.

4. Ammunition according to claim 3, wherein the subcaliber bullet comprises at its forward portion two concurrent conical surfaces, the centreline axis of which is that of the subcaliber bullet.

5. Ammunition according to claim 4, wherein one of the two concurrent conical surfaces has its portion of larger diameter facing forwards of the subcaliber bullet whereas the other conical surface has its portion of larger diameter facing backwards of the subcaliber bullet.

6. Ammunition according to claim 3, wherein at least one incipient breaking point consists of a slot parallel to the centreline axis of the subcaliber bullet.

7. Ammunition according to claim 3, wherein the incipient breaking points consist of three slots extending radially from the outside towards the centreline axis of the subcaliber bullet and spaced by 120°.

8. Ammunition according to claim 1, wherein the feathering is made from a plastics material.

9. Ammunition according to claim 1, wherein the head is made from lead.

10. Ammunition according to claim 3, wherein at least one incipient breaking point consists of a cylindrical groove opening forwards of the bullet and extending rearwards of the bullet and having its centreline axis parallel with the centreline axis of the bullet.

* * * * *